US005390095A

United States Patent [19]

Lemons et al.

[11] Patent Number: 5,390,095

[45] Date of Patent: Feb. 14, 1995

[54] VISUAL SIGNALING DEVICE

[75] Inventors: Thomas M. Lemons, Marblehead; Mark J. Wierbilis, Marlboro, both of Mass.

[73] Assignee: Space Age Electronics, Inc., Marlboro, Mass.

[21] Appl. No.: 219,278

[22] Filed: Mar. 29, 1994

[51] Int. Cl.[6] ..... F21V 7/06

[52] U.S. Cl. ..... 362/301; 362/346; 362/297; 362/349

[58] Field of Search ..... 362/346, 347, 297, 217, 362/304, 301, 298, 349, 343, 347

[56] References Cited

U.S. PATENT DOCUMENTS

| | | | |
|---|---|---|---|
| 330,742 | 11/1885 | Scovil | 362/346 |
| 678,942 | 7/1901 | Cox | 362/349 |
| 823,392 | 6/1906 | Burnfield | 362/297 |
| 1,224,189 | 5/1917 | Maltby | 362/343 |
| 1,365,319 | 1/1921 | Hazard | 362/349 |
| 1,658,265 | 2/1928 | Thompson | 362/346 X |
| 1,903,330 | 4/1933 | Young et al. | 362/297 X |
| 1,950,380 | 3/1934 | Arras | 362/297 |
| 4,308,573 | 12/1981 | McNamara, Jr. | 362/349 X |
| 4,409,646 | 10/1983 | Baliozian | 362/301 X |

*Primary Examiner*—Ira S. Lazarus
*Assistant Examiner*—Thomas M. Sember
*Attorney, Agent, or Firm*—Blodgett & Blodgett

[57] ABSTRACT

A visual signaling device which has a horizontally extending lamp which is connected to an electrical housing and which is surrounded by a reflector body. The reflector body has a pair of oppositely extending horizontal parabolic troughs and a downwardly extending horizontal trough. Each trough has an input opening adjacent the lamp, an output end opening, and a front opening. Each trough is defined by a generally planar back wall and a pair of opposed side walls. Each side wall is horizontal from the back wall to the front opening and parabolic relative to the central longitudinal axis of the lamp from the input opening to the output end opening. In a second embodiment of the invention, the reflector has an upwardly extending parabolic trough.

15 Claims, 6 Drawing Sheets

| Degrees | Percent of Rating |
|---|---|
| 0 | 100 |
| 5 – 25 | 90 |
| 30 – 45 | 75 |
| 50 | 55 |
| 55 | 45 |
| 60 | 40 |
| 65 | 35 |
| 70 | 35 |
| 75 | 30 |
| 80 | 30 |
| 85 | 25 |
| 90 | 25 |

| Degrees | Percent of Rating |
|---|---|
| 0 | 100 |
| 5 – 25 | 90 |
| 30 – 45 | 75 |
| 50 | 55 |
| 55 | 45 |
| 60 | 40 |
| 65 | 35 |
| 70 | 35 |
| 75 | 30 |
| 80 | 30 |
| 85 | 25 |
| 90 | 25 |

| Degrees θ | Percent of Rating |
|---|---|
| 0 | 100 |
| 5 – 30 | 90 |
| 35 | 65 |
| 40 | 46 |
| 45 | 34 |
| 50 | 27 |
| 55 | 22 |
| 60 | 18 |
| 65 | 16 |
| 70 | 15 |
| 75 | 13 |
| 80 | 12 |
| 85 | 12 |
| 90 | 12 |

VISUAL SIGNALING DEVICE

BACKGROUND OF THE INVENTION

The present invention is directed generally to a visual signaling device which is part of a safety alarm system in the room or other spaces of a dwelling. The present invention is specifically directed to a visual signaling device which includes an electric lamp which is mounted in a housing which has reflective surfaces for distributing light in a predetermined pattern to predetermined areas of the room. In most instances, the authority having jurisdiction for building requirements relies on a standard for safety which is published by underwriters, laboratories, and is identified as "Signaling Device For The Hearing Impaired" UL 1971, published Jun. 30, 1992. This publication is incorporated herewith by reference. The pattern of light intensity which is delivered to specific areas of the room by a visual signaling device must conform to the minimum requirements of this standard. In accordance with the UL standard in the above-identified publication, for a visual signaling device located on a wall at a specific distance from the floor, circumpolar light output above zero axis, must be greater than or equal to percentage values noted in tables for vertical and horizontal dispersion. For prior art signaling devices, in order to meet minimum requirements for each angular increment from the signaling device, many areas of the room receive significantly more light than is required. Also, a significant amount of light escapes to areas of the room which are beyond the designated areas. This inefficiency requires that the light source have a greater intensity than that which would otherwise be required to meet the minimum requirements of the light dispersion standard. These and other difficulties experienced with the prior art visual signaling devices have been obviated in a novel manner by the present invention.

It is, therefore, a principal object of the present invention to provide a visual signaling device which satisfies a predetermined criteria of intensity of dispersed light to predetermined areas of a room and which has a minimum dispersal of light to areas of the room outside of said predetermined areas.

Another object of the present invention is the provision of a visual signaling device which satisfies a predetermined criteria of intensity of dispersed light to each of a plurality of predetermined angular segments of a room without exceeding, to a significant degree, the predetermined criteria of light intensity for each segment.

A further object of the present invention is the provision a visual signaling device which utilizes a light source of relative low intensity which satisfies a predetermined criteria of intensity of dispersed light to predetermined areas of a room.

With these and other objects in view, as will be apparent to those skilled in the art, the invention resides in the combination of pans set forth in the specification and covered by the claims appended hereto.

SUMMARY OF THE INVENTION

In general, the invention consists of a visual signaling device having an electrical housing which supports an elongated horizontally extending lamp and a reflector body which surrounds the lamp. The reflector body has a first parabolic trough which extends horizontally from one side of the lamp, a second parabolic trough which extends horizontally from the opposite side of the lamp, and a third parabolic trough which extends downwardly from the lamp. Each parabolic trough has an input opening adjacent the lamp, an output end opening at the end of the trough, and a front output opening adjacent at the front of the reflector. Each parabolic trough is defined by a generally planar back surface and a pair of opposed side surface. All surfaces are reflective and extend from the input openings, to the end output openings. The front output openings are opposite the back surfaces. Each surface of the trough is made of a polished highly reflective material for reflecting light from the bulb. The opposed side surfaces divert from each other from the input opening to the output end opening. Each back surface extends forwardly from its respective input opening to its respective output end opening. Each side surface is horizontal from the back surface to the output front opening and parabolic with respect to the longitudinal axis of the lamp from the input opening to the output end opening. In another embodiment of the invention, the reflector has an upwardly extending parabolic trough.

BRIEF DESCRIPTION OF THE DRAWINGS

The character of the invention, however, may be best understood by reference to one of the structural forms, as illustrated by the accompanying drawings, in which.

DESCRIPTION OF THE PREFERRED EMBODIMENT

Figure 1:
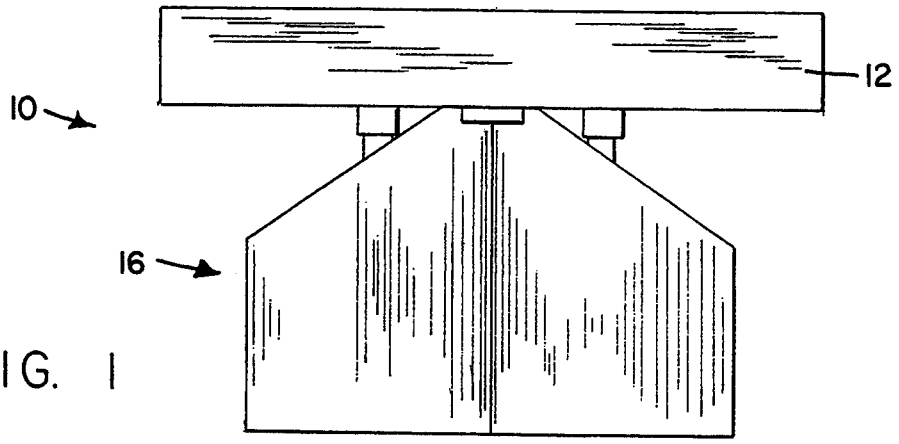
FIG. 1 is a top plan view of a visual signaling device embodying the principals of the present invention.

Referring to FIGS. 1–5, the visual signaling device of the present invention is generally indicated by the reference numeral 10 and includes an electrical housing 12 which supports an elongated horizontally extending light bulb 14 and a reflector body, generally indicated by the reference numeral 16. The light bulb 14 extends along a line of intersection between a vertical plane 18 and a horizontal plane 20.

The reflector body 16 has a front edge surface 22, a right side edge surface 24, a left side edge surface 26, and a bottom edge surface 28. A first parabolic trough, generally indicated by the reference numeral 30, is located at the right side of the light bulb 14. A second parabolic trough, generally indicated by the reference numeral 32, is located at the left side of the light bulb 14 and a third parabolic trough, generally indicated by the reference numeral 34, is located below the lamp 14.

The trough 30 is defined by a multifaceted planar back surface 42 and a pair of opposed upper and lower side surfaces 46 and 44, respectively. The second parabolic trough 32 is defined by a multifaceted planar back surface 54 and a pair of upper and lower side surfaces 55 and 57. The third parabolic trough 34 is defined by a multifaceted planar back wall 62 and left and right side surfaces 68 and 66, respectively. The back planar surface 62 has an auxiliary or extending portion 64 which extends below the bottom edge surface 28.

The upper surfaces 46 and 45 of the first and second troughs 30 and 32, respectively, intersect at a horizontal edge 47 which is located just above the lamp 14. the lower surface 44 of the first trough 30 and the surface 66 of the third trough 34 intersect at a horizontal edge 37 which is below and to the right of the bulb 17. The lower surface 57 of the second trough 32 and the surface 68 of the third trough 34 intersects a horizontal edge 49 which is below and to the left of bulb 14.

The first trough 30 has an input opening which is defined by the horizontal edge 37 and 47, a first end output opening 38 at the first edge surface 24 and a front output opening 40 at the front edge surface 22.

The second trough 32 has an input opening which is defined by the horizontal edges 47 and 49, a second end output opening 50 at the second edge surface 26 and front output opening 52 at the front edge surface 22. The third trough 34 has an input opening which is defined by the horizontal edges 49 and 37, a third end output opening 59 at the bottom edge surface 28, and a front output opening 60 at the front edge surface 22.

The planar back wall of each trough comprises a plurality of facets which extend outwardly from the lamp 14, each facet lies on a plane which is at a slight angle with respect to the plane of an adjoining facet. The back surface of each trough, as a whole, extends forwardly at an angle to a plane which is perpendicular to the central longitudinal axis of the lamp 14. The back surfaces 42 and 54 of the first and second troughs 30 and 32, respectively, extends forwardly at an angle of between 30° and 40°, 35° being ideal. The back surface 62 of the third trough 34 extends forwardly at an angle of between 20° and 30°, 25° being ideal. Auxiliary portion 64 extends forwardly at an angle of between 40° and 50°, 45° being ideal.

Figure 7:
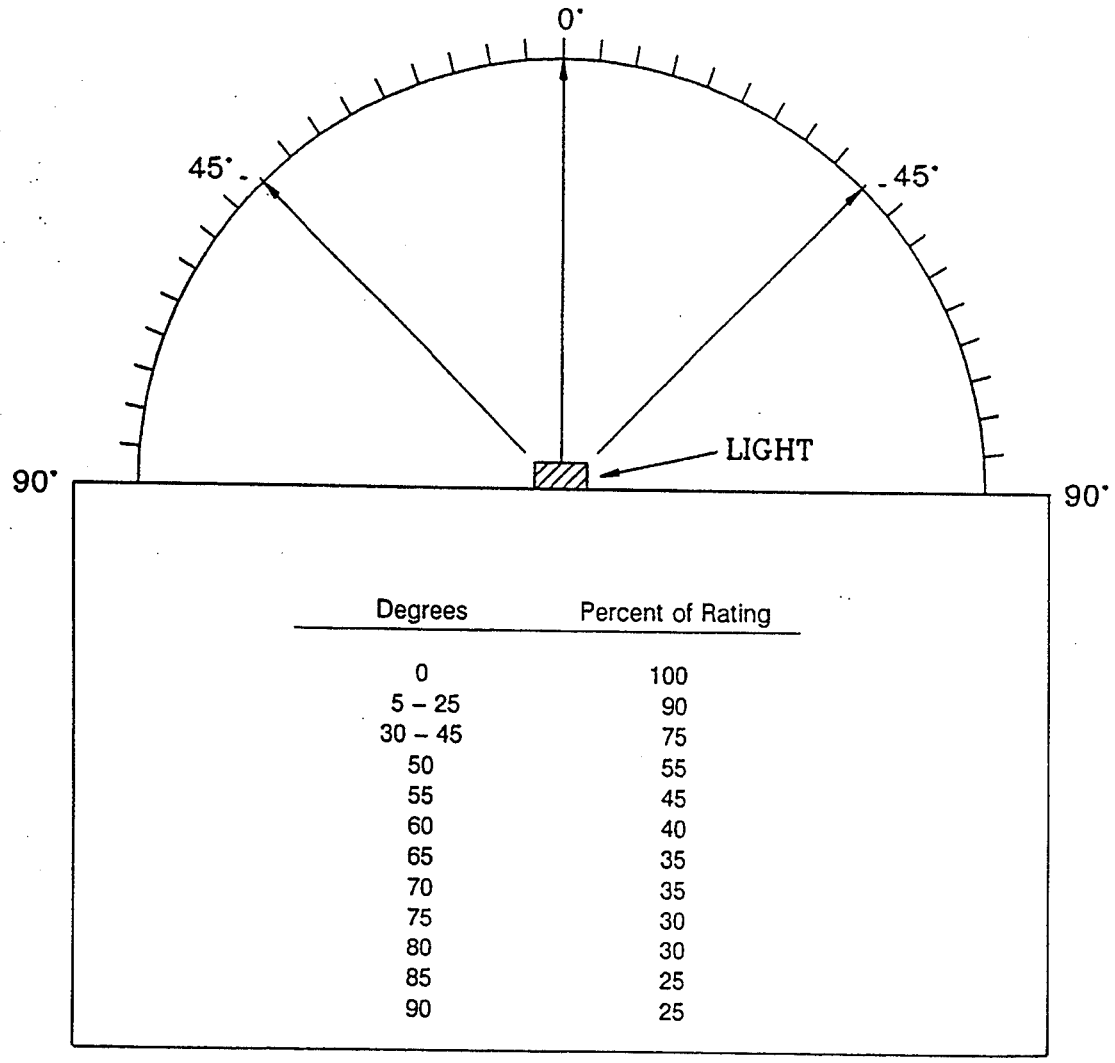
FIGS. 7–9 are diagrams with corresponding tables representing standard dispersion ratings for a visual signaling device.
Figure 8:
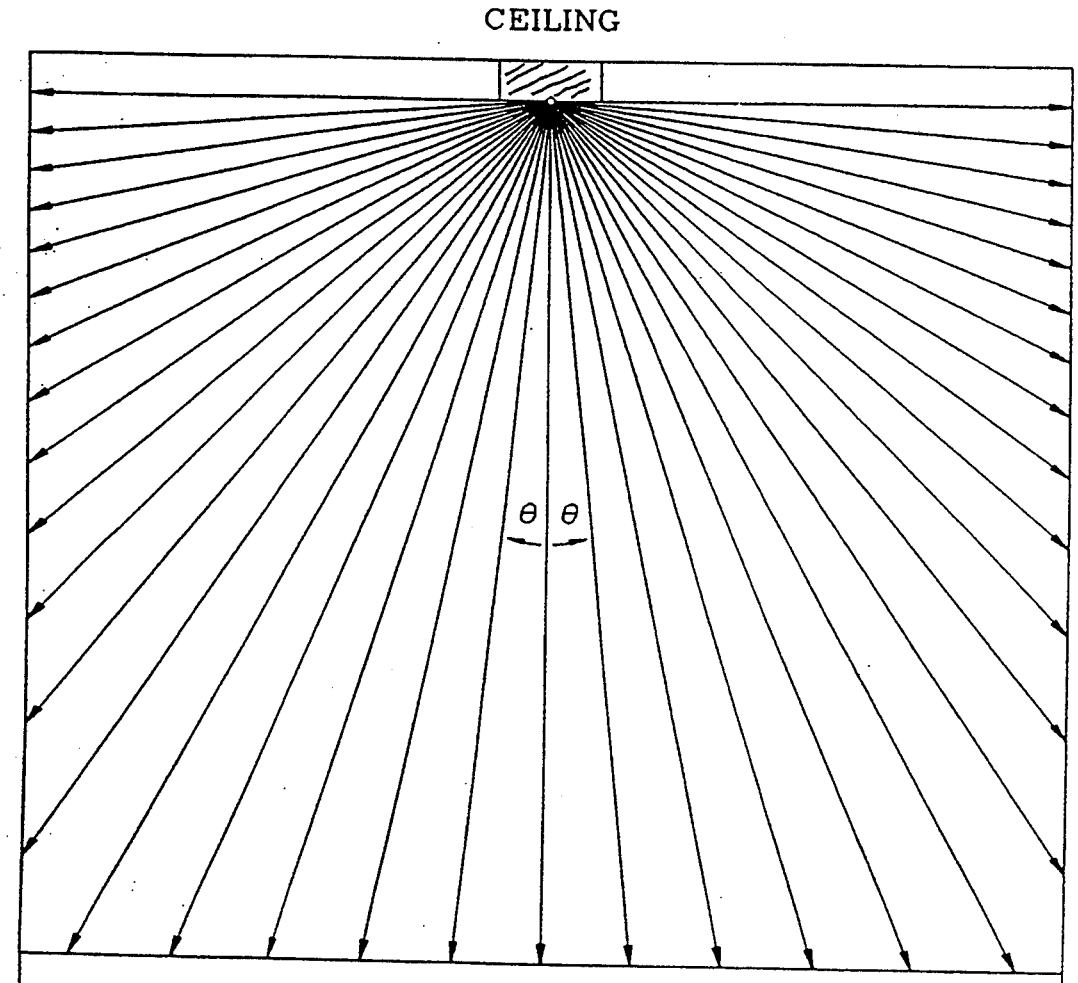
Figure 9:
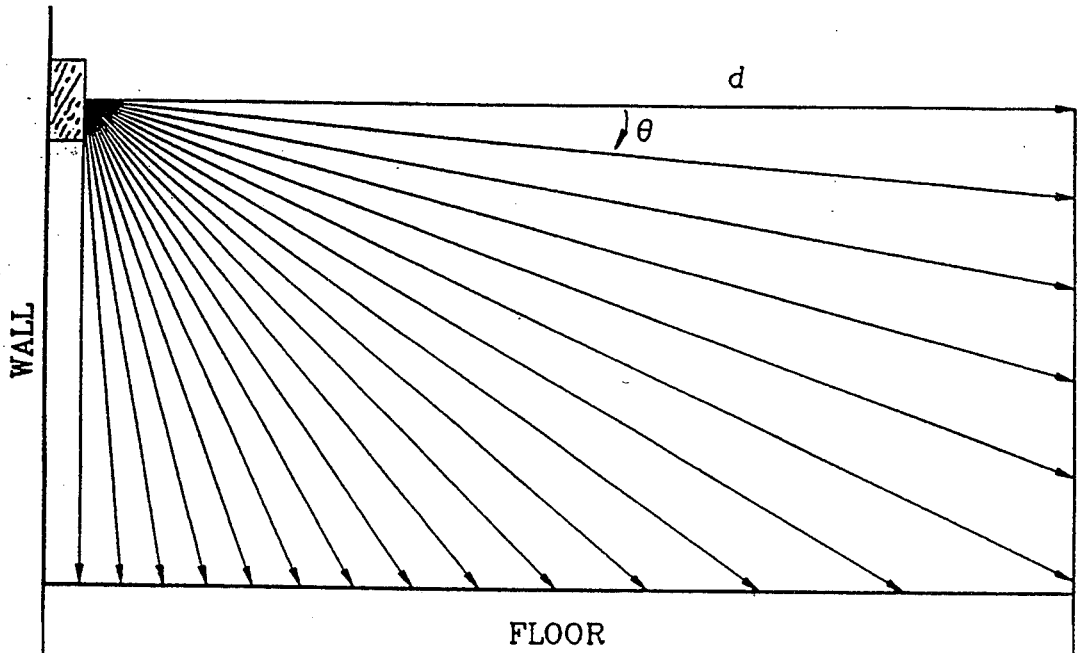

Referring to FIGS. 7–9, which are taken from the UL publication described previously, FIG. 7 is a plane View showing horizontal dispersion of light output. The rating is on axis measurement at 0°. FIG. 8 is a front elevational view showing the vertical dispersion of light output. The vertical dispersion is measured in both the x and y planes (one set of measurements, then rotate 90° and repeat measurements) as viewed from below the light looking up from the floor. FIG. 9 is a side elevational view showing the vertical dispersion of light output for a visual signaling device that may be used at or below 60 (1.8 m) from the floor for producing a circumpolar light output above 0 axis greater than or equal to the percentage values shown in the table.

Figure 2:
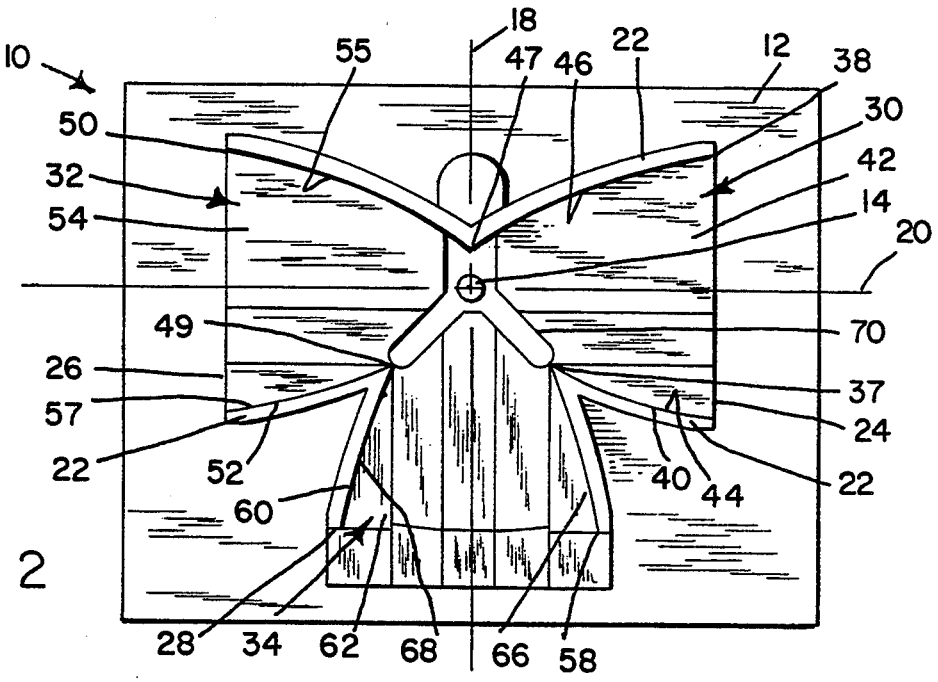
FIG. 2 is a front elevational view of the signaling device.
Figure 3:
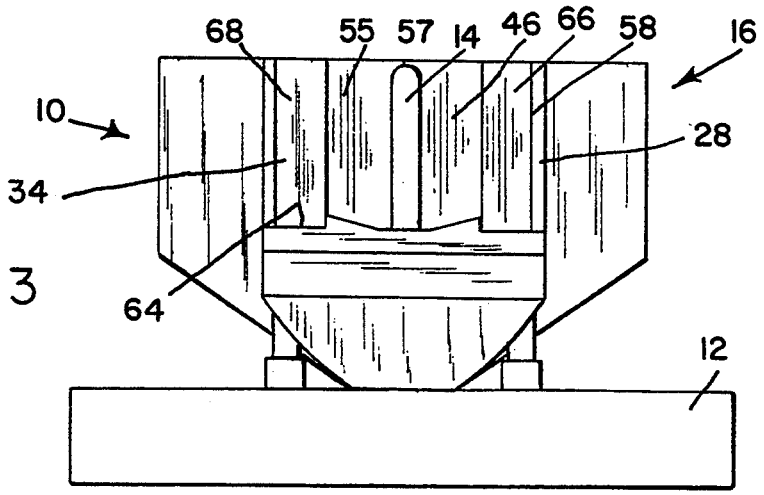
FIG. 3 is a bottom plan view of the signaling device.
Figure 4:
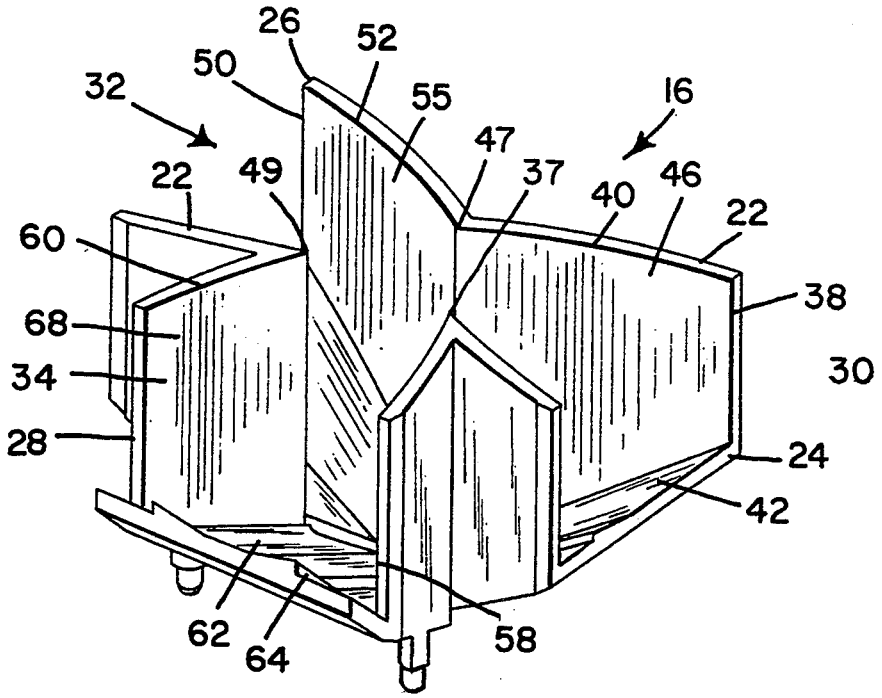
FIG. 4 is a perspective view of the reflector portion of the signaling device.
Figure 5:
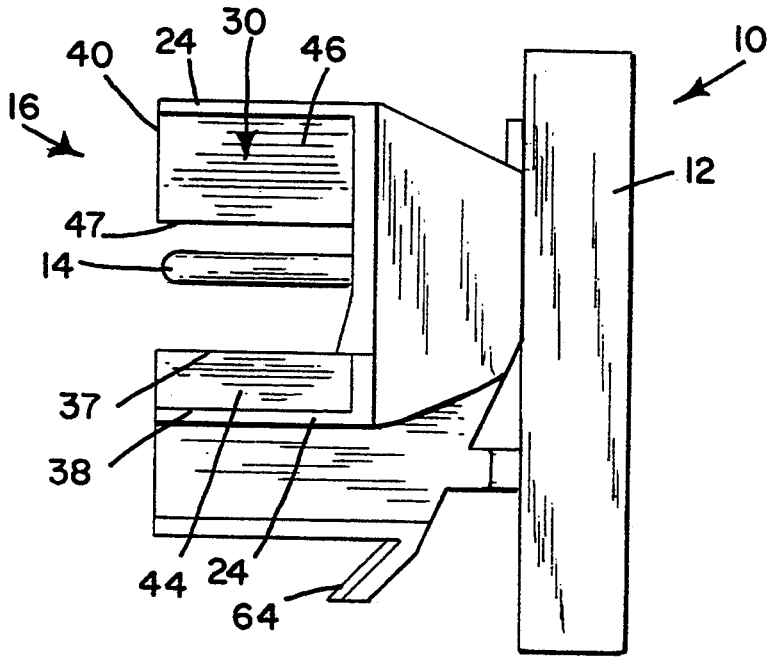
FIG. 5 is a fight side elevational view of the signaling device.

The surface of each trough is horizontal from its respective back surface to its respective front end opening and parabolic with respect to the central longitudinal axis of the lamp 14. The back and side surfaces of each trough is polished and highly reflective. The inner ends of the back surfaces of the troughs 30, 32, and 34 adjacent the lamp 14 define an inverted Y-shaped aperture 70. The lamp 14 which is electrically connected to the electrical housing 12 extends through the opening 70, as shown in FIG. 2. The arrangement of the reflective surfaces of the reflector 16 are such that the light which is reflected from the lamp 14 is distributed substantially in accordance with the degree ratings shown in the charts of FIGS. 7–9 with very little light escaping beyond the field which is shown in the diagrams.

MODIFIED REFLECTOR

Figure 6:
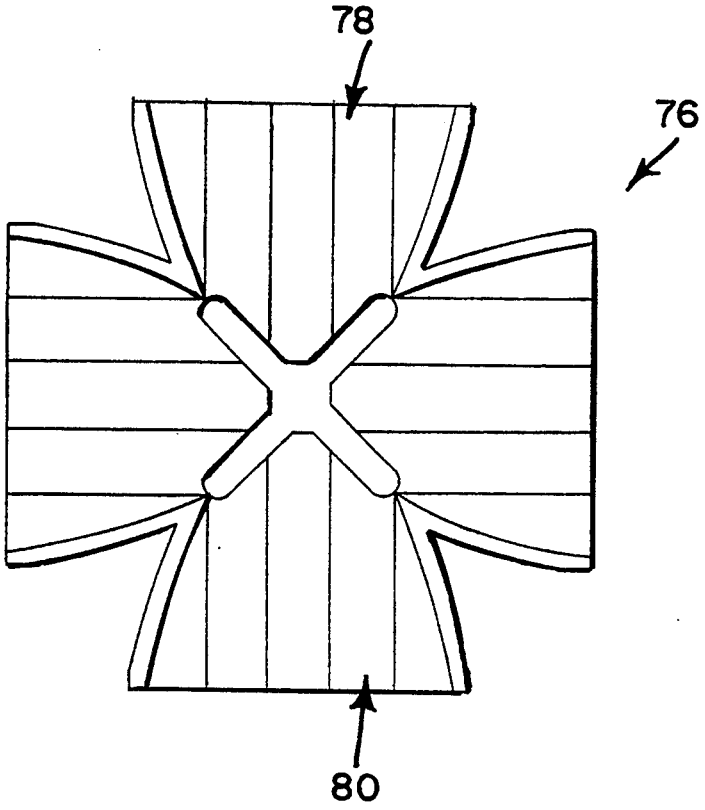
FIG. 6 is a front elevational view of a modified reflector.

Referring to FIG. 6, there is shown a modified reflector, generally indicated by the reference numeral 76 which is identical to the reflector 16 except that the reflector 76 has a fourth parabolic trough, generally indicated by the reference numeral 78, which extends upwardly from the lamp 14. The fourth trough 78 is directly opposed to the downwardly extending trough, generally indicated by the reference numeral 80. Neither the upwardly or downwardly extending troughs 78 and 80, respectively, as shown in FIG. 6 have the equivalent of the auxiliary or extending portion 64 of the reflector 16. However, under certain conditions each of the troughs 78 and 80 may be provided with an extension such as extension 64 of the reflector 16. The back wall of the third and fourth trough 80 and 78, extends formally at the same range of angles as for the third trough 34 of reflector 16.

The modified reflector 76 is utilized in certain situations which require the visual signaling device to be seen from all points of the room, including areas above the signaling device.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desire to secure by Letters Patent is:

1. A reflector for a luminous signaling device for reflecting light from an elongated light source, the source having a first end, a second end, and a horizontal central longitudinal axis, said reflector comprising;

(a) a socket for receiving the first end of the elongated source;

(b) three partial parabolic troughs, each trough having two opposed side surfaces, each side surface being parallel to the axis of the source, each trough having a cross-section, in a plane which is perpendicular to the axis of the source, which forms a portion of a parabola having a focus on said horizontal axis of the source;

(c) each trough having an input opening adjacent the source and an end output opening distant from the source;

(d) each trough having a back surface which is generally planar and which extends from each input opening adjacent the socket at an angle to the axis of the source in a direction toward the second end of the source to the respective end output opening;

(e) each trough having a front output opening which opposes said back surface;

(f) wherein each trough has a central axial plane, the central axial plane of two of the troughs being coplanar and passing through the axis of the source, the central axial plane of the third though being perpendicular to said coplanar central axial planes and also passing through the axis of the source; and (g) all trough side walls and floors being polished and reflective.

2. A reflector as recited in claim 1, wherein the shape of the parabolic cross-section of the troughs is defined substantially by $y^2=X/4$.

3. A reflector as recited in claim 1, wherein the angle made by each back surface is from a perpendicular to the axis of the source, the angle of said two coplanar troughs being between 30° and 40° and the angle of said third trough being between 20° and 30°.

4. A reflector as recited in claim 1, wherein the two troughs having coplanar central axial planes intersect with the trough having a perpendicular central axial plane to form a first and second common edge and wherein a plurality of wedge-shaped prominences are provided on the back surfaces of the troughs, the prominences each having a vertex edge and an opposite face, the prominence extending from each common edge to the respective end outlet opening of each trough, whereby the two troughs having coplanar central axial planes each have one prominence, while the trough having the perpendicular central axial plane has two prominences.

5. A reflector as recited in claim 4, wherein the wedge-shaped prominences each make an angle of substantially 10° with the respective trough back surface.

6. A reflector as recited in claim 1, wherein the back surface of the trough having the perpendicular central axial plane is proved with an extension which extends beyond the respective first outlet opening, said extension being angled toward the second end of the source and forming an angle of substantially 45° to a line which is perpendicular to the axis of the source.

7. A visual signaling device comprising:

(a) an electrical housing having a socket;

(b) an elongated lamp which is operatively connected to said socket and which extends horizontally along a line of intersection between a vertical plane and a horizontal plane; and (c) a reflector body which is attached to said electrical housing, said reflector body having a front surface, a first side surface which is substantially parallel to and spaced from said vertical plane at a first side of said vertical plane, a second side surface which is substantially parallel to and spaced from said vertical plane at a second side of said vertical plane, a bottom surface which is substantially parallel to and spaced below said horizontal plane, a first parabolic trough which has a first end output opening at said first side surface, a second parabolic trough which has a second end output opening at said second side surface and a third parabolic trough which has a third end output opening at said bottom surface, each of sail parabolic troughs being further defined by a generally planar back reflective surface, a front output opening at said front surface which opposes said back reflective surface, an input opening which is adjacent said lamp and a pair of opposed reflective surfaces which diverge with respect to each other from their respective input opening to their respective end output opening, each of said opposed reflective surfaces being horizontal from its respective planar back reflective surface to said from surface and parabolic trough having a focus on said line of intersection, each of said back planar surfaces extending toward said front surface at an acute angle from a line which is perpendicular to said line of intersection.

8. A visual signaling device as recited in claim 7, wherein each of said planar back reflective surfaces comprises at lest two planar facets which lie in different planes each of said facets extending from the end opening of its respective parabolic trough toward said vertical plane.

9. A visual signaling device as recited in claim 7, wherein said acute angle of the back planar reflective surface of each of sad first and second parabolic troughs is between 30° and 40° and said acute angle of the back planar surface of said third trough is between 20° and 30°.

10. A visual signaling device as recited in claim 9, wherein the back reflective surface of said third parabolic trough has a downwardly and forwardly extending auxiliary portion which extends below said third end output opening of said third parabolic trough.

11. A visual signaling device as recited in claim 10, wherein said auxiliary portion extends forwardly at an acute angle to the remainder of the back reflective surface of said third parabolic trough.

12. A visual signaling device as recited in claim 11, wherein each of said planar back reflective surfaces comprises at least two planar facets which lie in different planes.

13. A visual signaling device as recited in claim 7, wherein the back reflective surface of said third parabolic trough has a downwardly and forwardly extending auxiliary portion which extends below said third end output opening of said third parabolic trough.

14. A visual signaling device as recited in claim 7, wherein said housing has a top surface which is substantially parallel to and spaced above said horizontal plane, said signalling device further comprises a fourth parabolic trough which has a fourth end output opening at said top surface, said fourth parabolic trough being identical to said first, second, and third parabolic troughs.

15. A visual signaling device as recited in claim 7, wherein the shape of the parabolic curve which is defined by each of said opposed reflective surfaces is defined substantially by $y^2 = x/4$.

* * * * *